US005295932A

United States Patent [19]

Rowan

[11] Patent Number: 5,295,932

[45] Date of Patent: Mar. 22, 1994

[54] STILTS

[76] Inventor: Michael G. Rowan, Main Castle, East Kilbride, Glasgow, Scotland, G74 4NR

[21] Appl. No.: 917,048

[22] PCT Filed: Feb. 5, 1991

[86] PCT No.: PCT/GB91/00169

§ 371 Date: Sep. 25, 1992

§ 102(e) Date: Sep. 25, 1992

[87] PCT Pub. No.: WO91/11222

PCT Pub. Date: Aug. 8, 1991

[30] Foreign Application Priority Data

Feb. 5, 1990 [GB] United Kingdom ..... 9002510

[51] Int. Cl.[5] ..... A63B 25/02

[52] U.S. Cl. ..... 482/76; 482/75

[58] Field of Search ..... 482/75, 76, 77, 121, 482/126; 623/28, 32, 38, 47, 49, 52

[56] References Cited

U.S. PATENT DOCUMENTS

| | | | |
|---|---|---|---|
| 399,699 | 3/1889 | Sachs | 482/126 |
| 2,357,893 | 9/1944 | Harrington | 623/49 |
| 2,835,493 | 5/1958 | Skaggs . | |
| 3,065,962 | 11/1962 | Hoffmeister | 482/75 |
| 3,070,807 | 1/1963 | Wheeler | 482/75 |
| 3,110,492 | 11/1963 | Hoffmeister | 482/76 |
| 3,278,946 | 10/1966 | Godwin | 623/28 |
| 3,660,920 | 5/1972 | Spina | 482/75 |
| 4,058,119 | 1/1977 | Rosequist | 623/28 |
| 4,415,063 | 11/1983 | Hutchinson | 482/75 |
| 4,570,926 | 2/1986 | Ensmenger | 623/32 |
| 4,605,417 | 8/1986 | Fleischauer | 623/49 |
| 4,927,137 | 5/1990 | Speer . | |
| 5,019,109 | 5/1991 | Voisin | 623/52 |

FOREIGN PATENT DOCUMENTS

| | | | |
|---|---|---|---|
| 447958 | 7/1927 | Fed. Rep. of Germany . | |
| 0564989 | 1/1924 | France | 623/28 |

*Primary Examiner*—Richard J. Apley
*Assistant Examiner*—Lynne A. Reichard
*Attorney, Agent, or Firm*—Krass & Young

[57] ABSTRACT

A pair of stilts are provided. Each of the stilts has a resilient flexible foot which can be hinged or integral with the lower stilt leg portion. The resilient flexible foot has first and second projections defining a channel that receives a third projection from the lower stilt portion. The third projection has a horizontal slot to register with vertical slots in the first and second projections. In another embodiment the stilt further includes a shin protector.

9 Claims, 5 Drawing Sheets

STILTS

BACKGROUND OF THE INVENTION

1. Field of the Invention

The present invention relates to stilts.

2. Description of the Related Art

Stilts are well known and are structures designed to increase the height of an individual and to permit the individual to walk from one position to another at an elevated height. Stilts are generally worn by circus clowns and the like, but specialist stilts can be worn by tradesmen who have to work in areas of higher than average height and where it is otherwise difficult to instal platforms, ladders and the like.

The most common type of stilts consists of a pair of long poles each having an offset foot-support platform and, to use the stilts, the wearer grips the top of the poles with his hands and places his feet on the platforms, which extend inwardly from the poles when in use. A disadvantage of this arrangement is that the weight of the user does not act through the pole but, instead, acts in a path parallel to the direction of the pole with the result that there is an inward moment created at the top of the poles. This commonly results in a knock-kneed appearance of the stilt user and it is difficult for the user to walk with the stilts in such a position.

An improved type of stilt consists of a structure which has a foot support with an offset leg support although the weight of the foot acts directly through the bottom of the stilt. This overcomes the problems associated with the offset foot support but a problem with this type of stilt is the inability of the user to ambulate properly. The user can generally only walk quite slowly and it is difficult if not impossible, for the wearer to run. Another problem with existing stilts is that because they have no resilience ground contact shocks pass directly to the wearer's ankles, knees and hips.

U.S. Pat. No. 2,835,493 to Skaggs et al describes hydraulically adjustable stilts which include a ground engaging base plate which is pivotally mounted to a lower leg portion, with springs disposed at each side of the pivot between the leg and the base plate to provide a restraining action in the ankles of persons using the stilt. while the pivotal connection provides for proper contact of the base plates with the ground.

German Patent No. 447,958 discloses a shoe for strapping to a person's foot comprising two spaced plates, the upper plate having stub axles for location in vertical slots formed in upstanding projections from the lower plate. A pair of coil springs are located between the plates and hold the upper plate in a raised position.

The arrangement disclosed by Skaggs would not provide any cushioning for the wearer whilst walking or running. Although the shoe disclosed by the German patent would provide cushioning, this would not be controlled and would likely result in considerable vertical movement of the upper plate; such movement would not be acceptable in a stilt.

SUMMARY OF THE INVENTION

An object of the present invention is to provide an improved type of stilts which obviates or mitigates at least one of the disadvantages associated with the aforementioned forms of stilts.

According to one aspect of the present invention there is provided a pair of stilts in which each stilt has a foot support portion coupled to an upper leg portion and to a lower leg portion, each lower leg portion having flexible foot means resiliently coupled to the bottom thereof whereby the weight of the wearer acts directly from the foot support portion through the lower leg portion and the flexible foot means, each flexible foot means being pivotably mounted to a respective lower leg portion by an axle and the front and rear of each flexible foot being coupled to the respective lower leg portion by spring means and each flexible foot having a pair of upstanding projections defining a front-to-back channel therein for receiving a projection extending from the bottom of the lower leg portion, characterised in that each projection has a substantially horizontal aperture therein to register with vertical slots in said upstanding projections, said axle being disposed in said slots and said aperture to permit pivoting about a side-to-side axis and wherein a resilient element is disposed between the bottom of said projection and the upper part of said flexible foot means.

With this arrangement the resilient foot deforms during walking to permit ease of gait in the manner similar to normal walking. It is also possible for the stilt wearer to run and to move much more easily than using stilts with rigid feet.

Preferably, each stilt consists of separate upper and lower leg portions which are coupled together by coupling means at the lower end of the upper leg portions and the upper end of the lower leg portion.

Conveniently, that said upper leg portion is located at the front of said stilt to act as a shin protector, and the upper end of said upper leg portion has fastening means coupled thereto for fastening the stilt to the user's leg.

BRIEF DESCRIPTION OF THE DRAWINGS

These and other aspects of the present invention will become apparent from the following description when taken in combination with the accompanying drawings in which:

FIG. 11 is an enlarged view of FIG. 10 taken in the direction X showing how the top and bottom parts are slidably connected.

DESCRIPTION OF THE PREFERRED EMBODIMENTS

Figure 1:
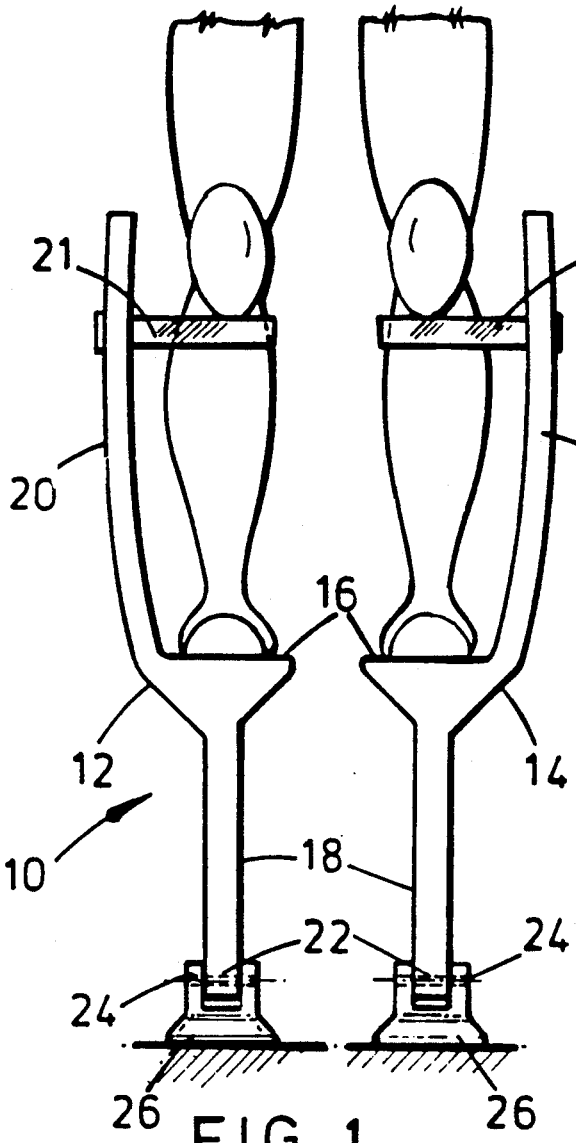
FIG. 1 is a side elevation of a person wearing stilts in accordance with an embodiment of the invention.
Figure 2:
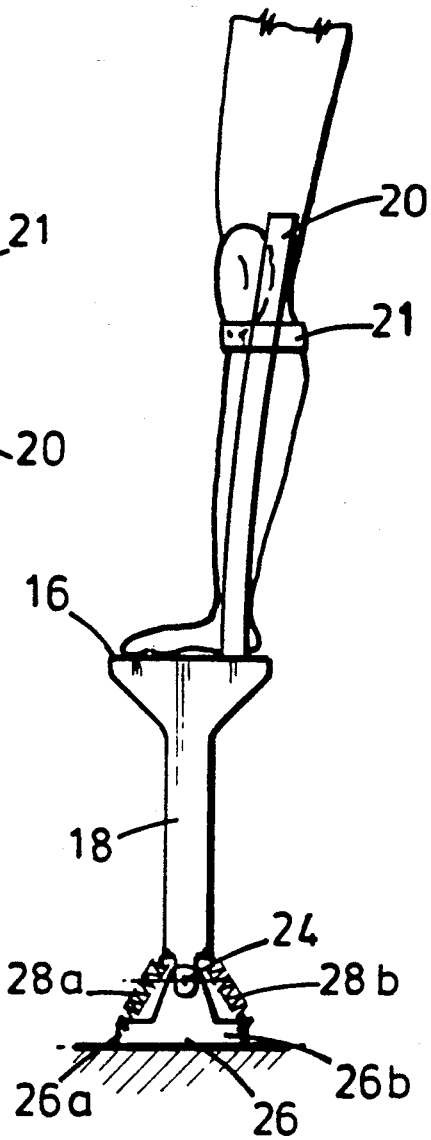
FIG. 2 depicts a side view of FIG. 1.

Reference is first made to FIGS. 1 and 2 of the drawing which depicts a person wearing a pair of stilts 10 in accordance with an embodiment of the invention. The stilts consist of two separate stilt members 12 and 14 and only one will be described in detail although it will be appreciated that both are similar in structure. Each stilt 12 has a foot support platform 16 which is integral with a lower stilt member 18 and an offset upper stilt member 20. The upper stilt member 20 has a hook and loop fastening strap 21 of, for example, VELCRO®, associated therewith to wrap round the calf of the user and secure the tilt to the leg. The lower stilt portion terminates in a narrow portion 22 which is pivotably coupled by a hinge 24 to afoot portion 26. The front and rear of the foot portion 26*a*, 26*b* respectively are coupled to the lower stilt member via strong resilient coil springs 28*a* and 28*b*.

In use, when the person wearing stilts wishes to walk he leans forward on one leg and the front spring 28*a* compresses and the person then lifts of this leg and during the swing phase of this leg the coil spring 28*a* extends the foot on heel contact by rear portion 26*b* the rear spring 28*b* compresses to take up the load and the other foot flexes as at push-off. The other leg is affected in the same manner and this action is repeated during normal reciprocal gait. With this arrangement it will be appreciated that gait is more controlled and the springs absorb any jarring or shocks thus making the wearing of the stilts more comfortable and easy to maneouvre. In addition, because the hinge acts as an ankle, the flexibility of the foot is somewhat similar to the natural human foot. Thus, ambulation is better and it is possible for the stilt wearer to be able to run with such stilts.

Figure 3:
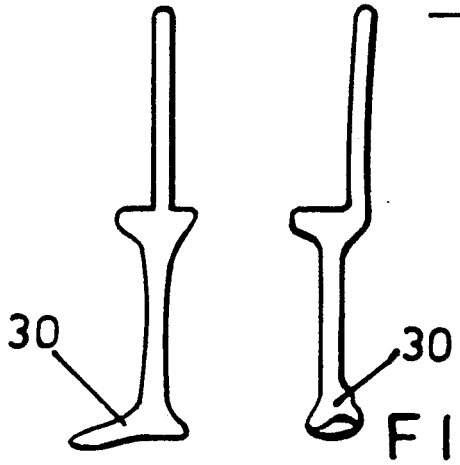
FIG. 3 depicts a stilt in accordance with a second embodiment of the invention.

Reference is now made to FIG. 3 of the drawing which depicts a second embodiment of stilts generally similar to that shown in FIG. 1 and 2 except that the lower stilt member is integral with a resilient foot 30. The entire stilt member is moulded from a two-part plastic material which has a highly resilient foot portion which causes it to deform at toe-off and to extend during the stance phase so that at heel strike the foot is positioned to take up the load of the wearer and thus mimic the natural foot during normal gait.

Figure 4:
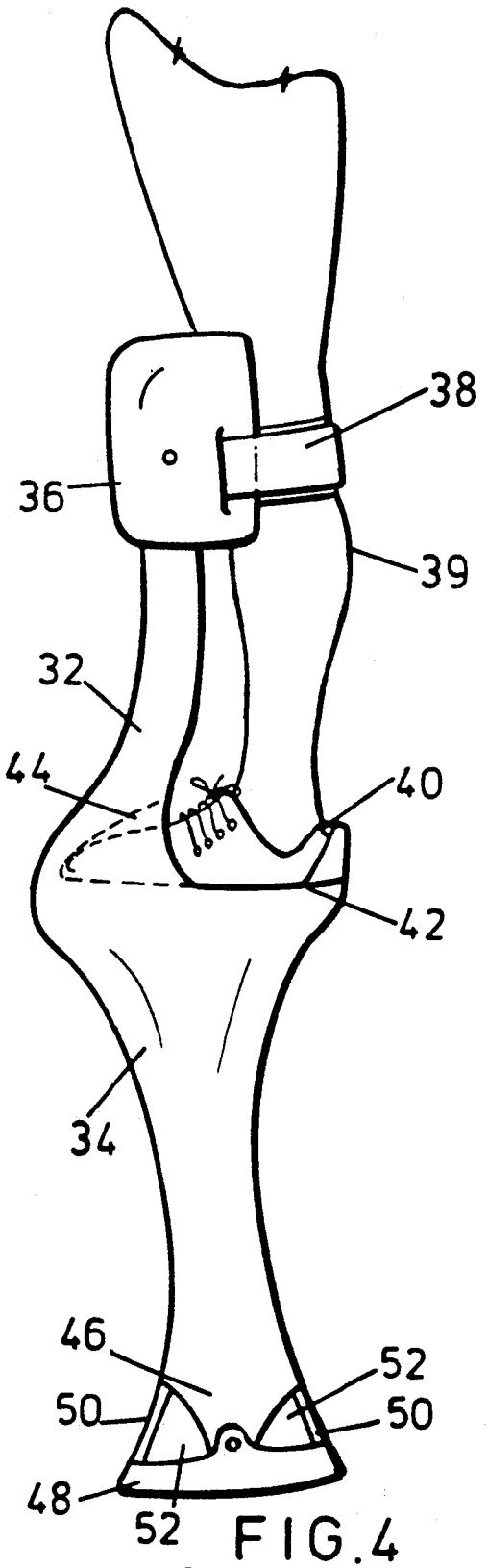
FIGS. 4 and 5 depict side and front views of a stilt in accordance with a third embodiment of the invention.
Figure 5:
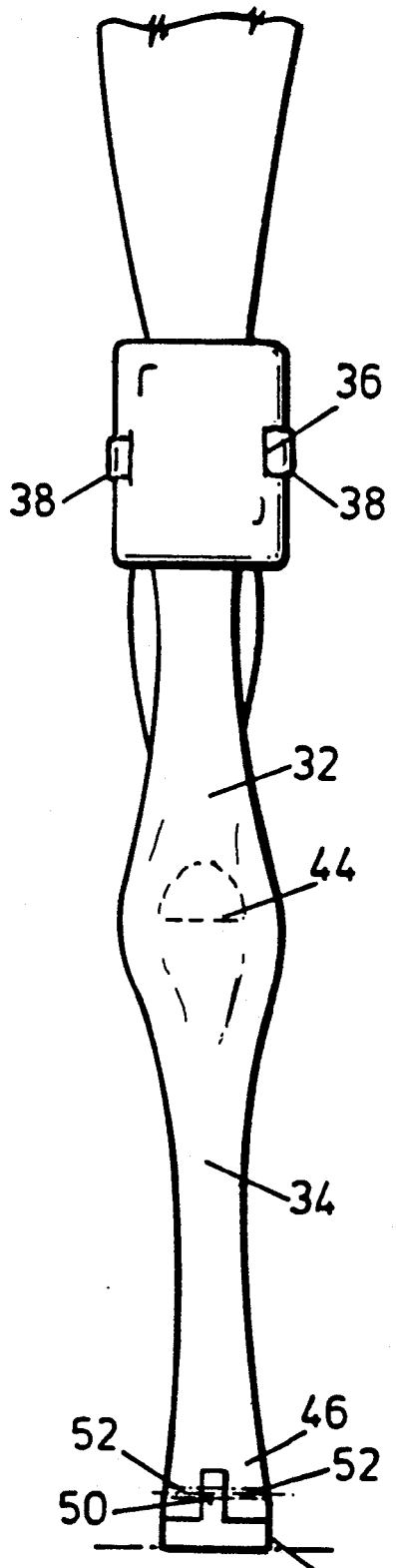

The reference is now made to a third embodiment of the invention which is shown in FIGS. 4 and 5 of the accompanying drawings. In this embodiment the upper stilts member 32 is aligned with the lower stilt member and the weight of the user acts through the lower stilt members 34. The upper and lower stilt members are integral and the upper stilt member acts as a shin protector and is coupled to a knee protector 36 which carries an adjustable leg strap 38 which can be fastened round the rear of the calf 39 as shown with hook and loop fasteners of, for example, VELCRO®. The foot 40 rests in a foot support 42 which is adjustable to accommodate various sizes of feet and the cavity 44 defines a toe receiving portion which may include resilient inserts so that the foot is firmly wedged in the stilt.

The lower stilt member 34 is hinged to a lower foot portion 48 to allow the lower foot portion to flex relative to the lower stilt member 34. The front and rear of the foot has guards 50 to prevent the foot from catching on carpets or stairs and the like. Disposed between the lower foot portion and the lower portion of the stilt 46 are resilient shock absorbing members 52 which may conveniently be made of a resilient polymer or a natural resilient rubber.

The stilts in this embodiment operate in a substantially identical manner to those described with reference to FIGS. 1 to 3 in that at toe-off the front resilient portion 22 compresses to give an active push and during the swing phase the energy is released to expand the rubber portion thus forcing the foot to the unloaded condition so that at heel strike the foot is in a position ready to take the load for that particular stilt member. This is repeated alternately for each stilt during normal gait.

Figure 6:
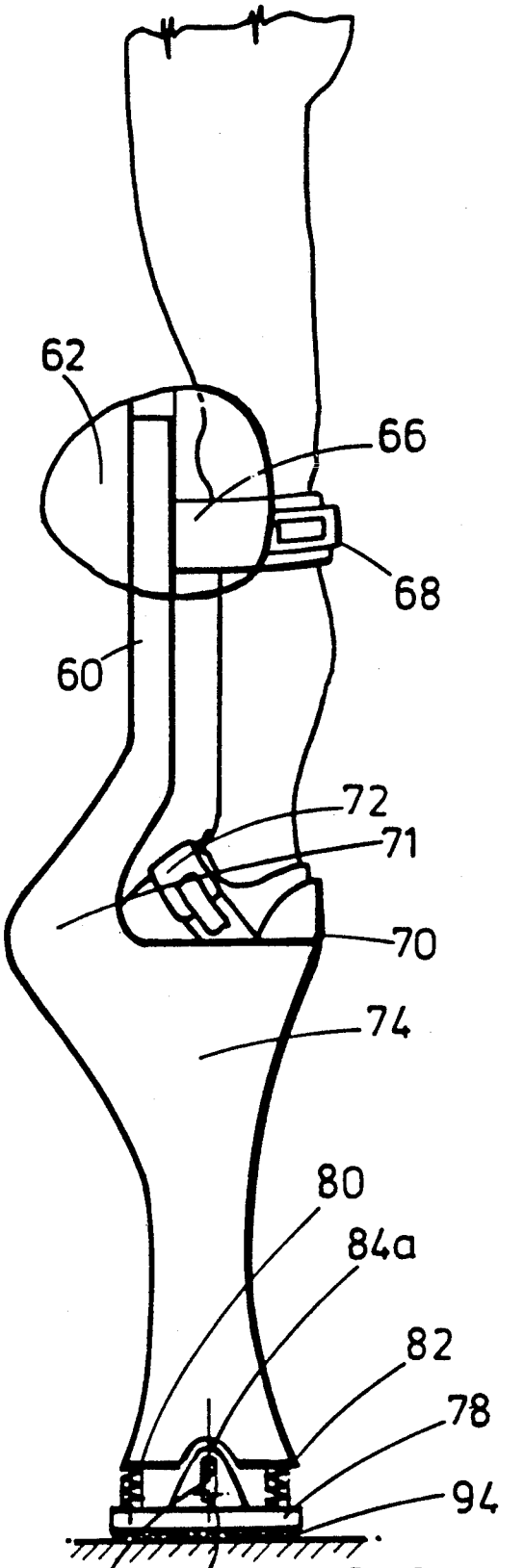
FIGS. 6 and 7 depicts front and side views of a stilt member in accordance with a fourth embodiment of the present invention.
Figure 7:
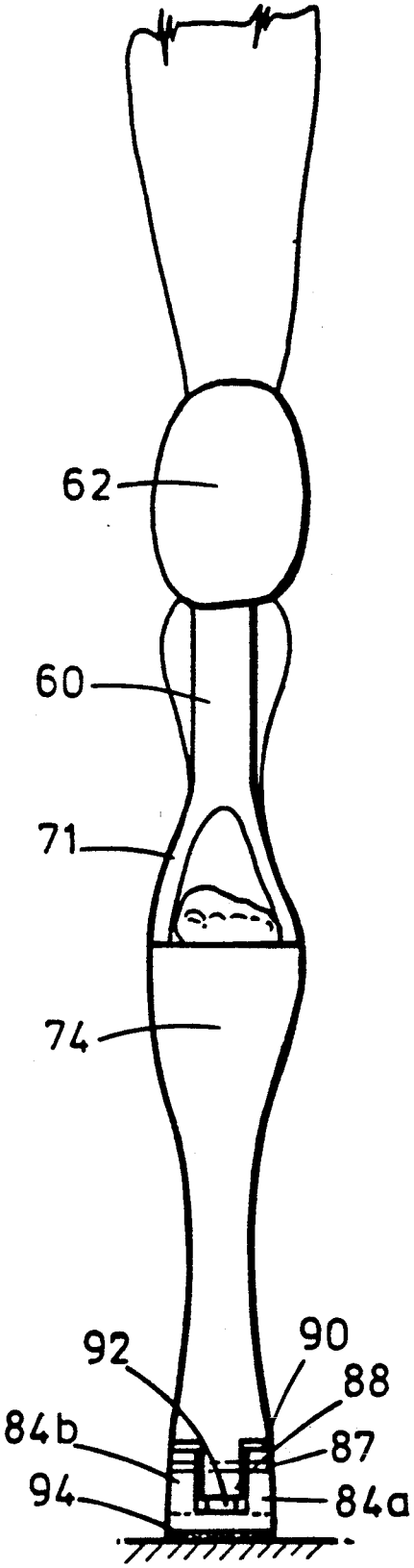

Reference is now made to FIGS. 6 and 7 of the drawings which depict a fourth embodiment of the invention which is similar in many respects to the embodiment shown in FIGS. 4 and 5. The upper stilt member 60 is a shin protector and the knee protector 62 consists of an outer foam shock absorber 64 and a height adjustable foam knee protector 66 (FIG. 6). The knee protector, and consequently the upper stilt member 60, is fastened to the wearer's leg at the popiliteal fossa by an adjustable padded ski-type binding 68. The foot sits on platform 70 within a foot-cowl 71 and is secured therein by ski-type binding 72, which are also adjustable.

The lower stilt member 74 is coupled via a hinge joint 76 to a sole 78 and by front and rear coil springs 80,82. The sole 78 has upstanding projections 84*a*,84*b* which have longitudinal slots 86*a*,*b* in which a hinge pin 87 in the form of a floating axle is located. As seen on FIG. 7 the lower end of the stilt member 74 has a projection 88 which fits between the projections 84*a*,84*b* and which also has an aperture 90 for receiving the floating axle 87. As seen in FIG. 7, a shock absorbing rubber pad 92 is also disposed between the top of the sole 78 and bottom of the projection 88 to cushion the wearer whilst walking or running. The bottom of the sole 78 has replaceable rubber tread 94 for grip and additional cushioning.

The stilt in this embodiment operates in a similar manner to that shown in FIGS. 4 and 5 except that the floating axle 87 permits much greater flexibility of movement, especially lateral movement and this results in a significant improvement in stability. This is because when a lateral force or moment is applied to the foot, the slots 86*a*,86*b* permit the floating axle to tilt relative to the horizontal so that the bottom of sole 78 remains in contact with the ground to a much greater extent than with the other embodiments.

The slot and axle is shown centralised but could be slightly offset as long as the centre of gravity passes through so that when the user at rest, the stilts are stable.

Figure 8:
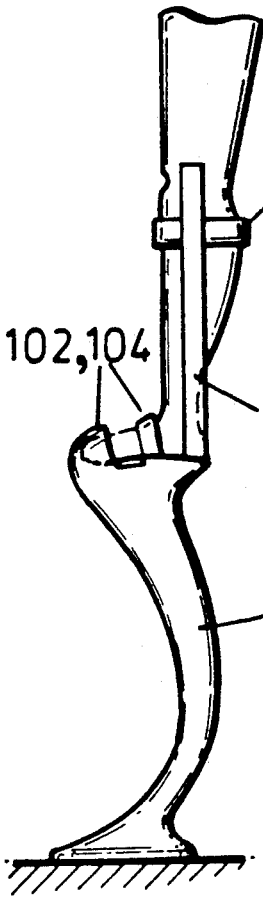
FIG. 8 is a side view of a stilt in accordance with a fifth embodiment of the invention.

Reference is now made to FIG. 8 of the accompanying drawings which depicts a stilt of a pair of stilts in accordance with the fourth embodiment of the invention. In this case the stilt is somewhat similar to that shown in FIG. 1 with the upper stilt member 96 being integral and being offset from a flexible lower stilt member 98. The lower stilt member 98 is made of a polymer which has a tendency to mimic the natural resilience of the foot and obviates the need for a hinged foot with resilient springs or plastics. The material is sufficiently rigid to support the user but is also sufficiently resilient so as to allow the wearer to run. Different resiliences can be used to allow the wearer to participate in a variety of sports and the like. The stilt is secured to the leg via a hook and loop fastening strap 100 of, for example VELCRO® attached to the upper limb member and by a toe cover 102 and foot strap 104 on each of the stilt members.

Figure 9:
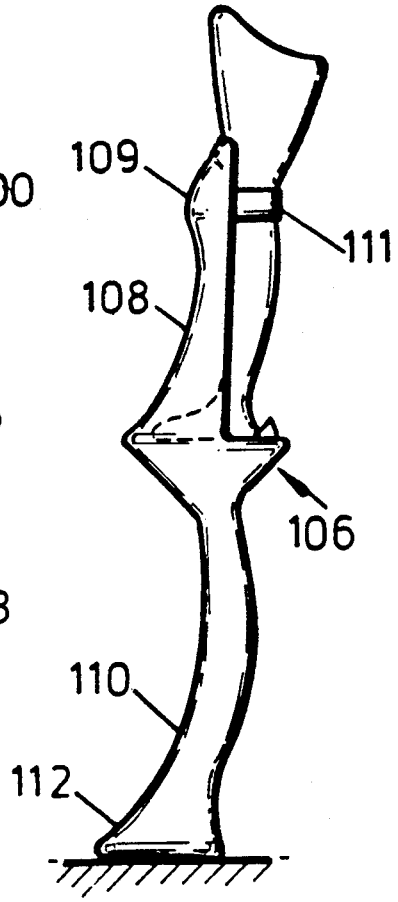
FIGS. 9 and 10 are side and front views of a stilt in accordance with a sixth embodiment of the invention.
Figure 10:
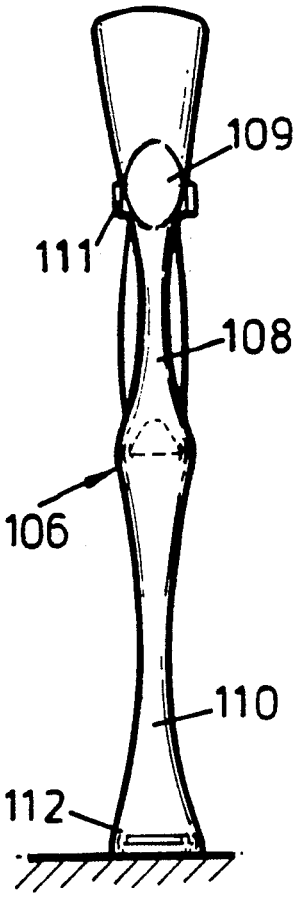

Reference is now made to FIGS. 9 and 10 of the accompanying drawings which depict the stilt member 106 which is similar overall to the member shown in FIGS. 4 and 5 although the lower stilt member 110 is similar to the lower member shown in FIG. 6 of the accompanying drawings. The upper stilt member 108 is integral with the lower member and a knee protector 109 which is fastened behind the calf, as before, by means of a hook and loop fastening strap 111 of, for example, VELCRO®. Lower stilt member 110 has an integral resilient foot 112 and this embodiment combines the advantages of the embodiment shown in FIGS. 4 and 5 and FIG. 8 so that the stilt has a variety of applications including sports. Moreover with this arrangement there is no requirement for a separate foot or assembly and the whole structure can almost be made in a single operation. However, the foot support can be made adjustable as with the embodiment of FIGS. 4 and 5.

Figure 11:
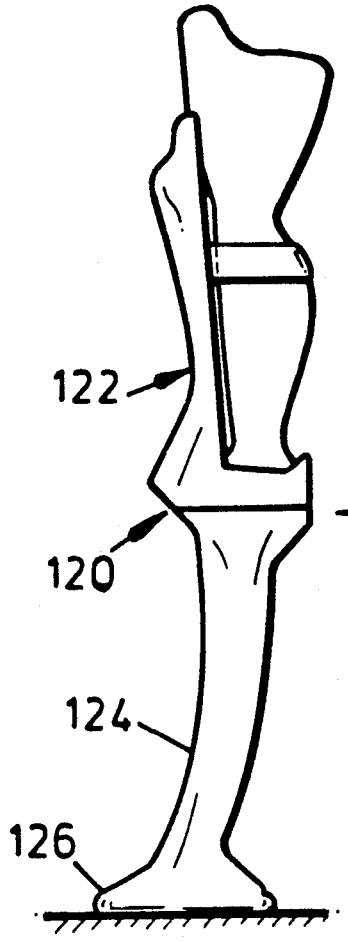
FIGS. 11 and 12 depict side and front views of a still in accordance with a seventh embodiment of the present invention.
Figure 12:
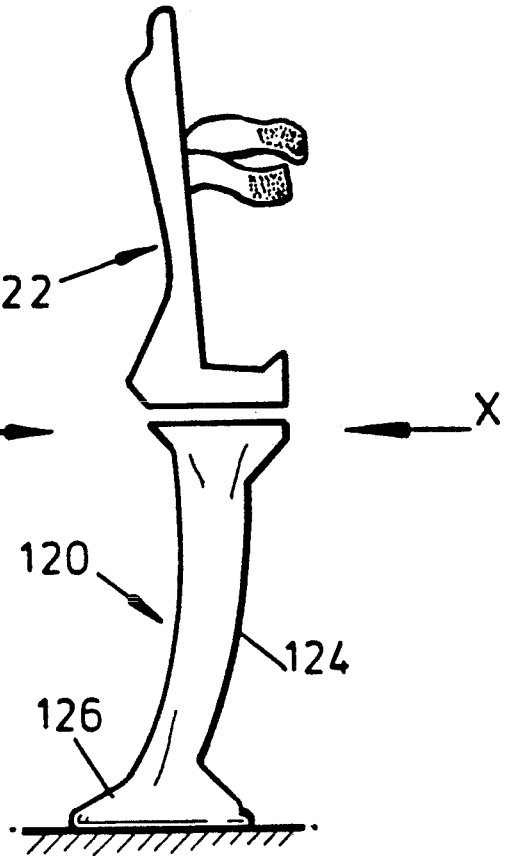
Figure 13:
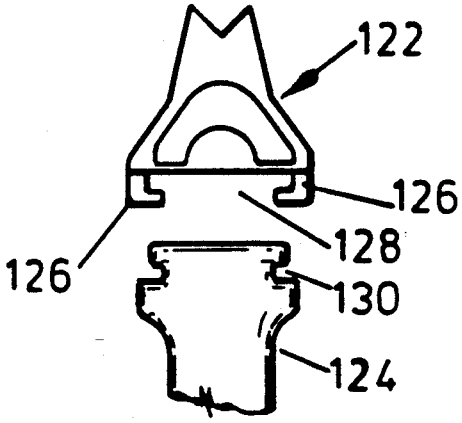

Reference is now made to FIGS. 11 and 12 of the accompanying drawings which depicts a further embodiment of the invention. In this embodiment a stilt member generally indicated by reference 120 consists of a separate upper stilt member indicated by reference 122, which acts as a shin and knee protector, and a lower stilt member 124, which is integral with a flexible foot 126, and which is sufficiently resilient to both support the wearer and allow the stilt wearer to run. The upper and lower members are coupled by a slidable connection best seen in FIG. 13. It will be seen that the upper stilt member has guide rails 126 which are proportioned and dimensioned to define a channel 128 for receiving, in a sliding connection,. a generally T-shaped top portion 130 of the lower stilt member 128. Once the sliding fit has been made, the upper and lower portions are secured therein by a conventional fastening means e.g. screw fasteners or by a cam over-centre mechanism which can lock the upper and lower members in place. It will be appreciated that an advantage of this arrangement is that the wearer can select different stilt members of different heights so as to give a different overall stilt height and can select different stilt members having different resiliences depending on the particular application. For example a particular resilient stilt member could be selected for sports applications with a less flexible more rigid member being selected for normal gait requirements. It will be appreciated that with these embodiments the stilts are superior to those of the prior art in that they permit the wearer to move easily and permit the user to jog or run. The stilts have application in many areas but particularly as a toy and in the entertainments industry. In addition, it is believed that the stilts may find application for use by tradesmen and the like, for example, fruit pickers, who have to wear stilts for jobs higher than average height but which are unsuitable for platforms and ladders or the like.

It will be appreciated that various modifications may be made to the embodiments hereinbefore described without departing from the scope of the invention, e.g. the stilts may be made in any suitable material which is sufficiently strong and provides appropriate load bearing capacity. This may also be wood or metal or a combination of these materials. In addition, the stilts may be made of moulded plastic. The coil springs in respect of the first embodiment may be replaced by any other suitable resilient means e.g. resilient rubber pads. The foot connection shown in the embodiment of FIGS. 6 and 7 may be used with the stilts of FIGS. 1 to 5. The stilts may be moulded in a one piece with different plastics using a composite moulding technique so as to allow the lower foot portion to be moulded in a more resilient material. Alternatively it will be appreciated that the resilient foot may be coupled to the lower stilt member by means of screw threads or any other suitable fastener in accordance with fastening arrangements well known in the art.

Advantages of the invention are that the stilts improve the maneouvrability of the wearer and thus improve the enjoyment of wearing stilts. In addition the stilts serve a useful function in that they improve gait which is desirable in the interests of safety. The stilts also permit the wearer to move more easily and to run. With the separate lower portion, stilts can be selected to suit specific applications; lower stilt members of different height and resilience can be selected depending on the particular requirements. It will be appreciated that the location of the wearer's foot can be adjustable both forward and sideways so as to minimise leg strain and the stilt foot is long enough to allow the user to stand still comfortably and is designed so as not to catch under carpets doors or the like which otherwise might trip the user. The springs, resilient blocks and the resilient feet act as shock absorbers which make the stilts far more comfortable to wear than traditional stilts The stilts may be mass produced in plastic leading to ease of manufacture and economy.

I claim:

1. A pair of stilts in which each stilt has a foot support portion coupled to an upper leg portion and to a lower leg portion, each lower leg portion having flexible foot means resiliently coupled to the bottom thereof whereby the weight of the wearer acts directly from the foot support portion through the lower leg portion and the flexible foot means, each flexible foot means being pivotably mounted to a respective lower leg portion by an axle and the front and rear of each flexible foot being coupled to the respective lower leg portion by spring means and each flexible foot having upstanding first and second projections defining a front-to-back channel therein for receiving a third projection extending from the bottom of the lower leg portion, characterised in that said third projection has a substantially horizontal aperture therein to register with vertical slots in said upstanding first and second projections, said axle being disposed in said slots and said aperture to permit pivoting about a side-to-side axis and tilting about a front-to-rear axis and wherein a resilient element is disposed between the bottom of said third projection and an upper part of said flexible foot means.

2. A pair of stilts as claimed in claim 1 characterised in that said spring means is a member made of resilient polymer or rubber.

3. A stilt as claimed in claim 1 wherein said foot support means has foot securing means for securely fastening the stilt to the foot of a user.

4. A pair of stilts as claimed in claim 1 in which a guard member is provided between the front of each foot means and the front of the respective lower leg portion, and a further guard member is provided between the rear of each foot means and the rear of the respective lower leg portion.

5. A pair of stilts as claimed in claim 1 characterised in that each stilt consists of separate upper and lower leg portions which are coupled together by coupling means at the lower end of the upper leg portion and the upper end of the lower leg portion.

6. A pair of stilts as claimed in claim 5 characterised in that the coupling means is a sliding connection provided by a generally C-shaped channel at the bottom of the upper leg member and a generally T-shaped portion at the top of the lower member.

7. A pair of stilts as claimed in claim 5 characterised in that said upper leg portion is located at the front of said stilt to act as a shin protector, and the upper end of said upper leg portion has fastening means coupled thereto for fastening the stilt to the leg of a user.

8. A pair of stilts as claimed in claim 7 characterised in that a knee protector is located at the top of said upper leg member, said knee protector having said fastening means.

9. A pair of stilts in which each stilt has a foot support portion coupled to an upper leg portion and to a lower leg portion, said upper leg portion being located at the front of said stilt and extending upwardly from the front of said foot support portion to act as a foot and shin protector, and the upper end of said upper portion having fastening means coupled thereto for fastening the stilt to the leg of a user.

* * * * *